United States Patent [19]

Hatta et al.

[11] 4,295,444

[45] Oct. 20, 1981

[54] AUTOMATIC COATING SYSTEM FOR LOST WAX PROCESS

[75] Inventors: Masami Hatta, Matsue; Katsumi Iwata, Saihakugun; Masao Sasaki, Fujisawa, all of Japan

[73] Assignee: Hitachi Metals Precision, Ltd., Tokyo, Japan

[21] Appl. No.: 104,854

[22] Filed: Dec. 18, 1979

[30] Foreign Application Priority Data

Dec. 22, 1978 [JP] Japan ..... 53-157613
Dec. 22, 1978 [JP] Japan ..... 53-174971[U]
Dec. 22, 1978 [JP] Japan ..... 53-174972[U]

[51] Int. Cl.[3] ..... B05C 3/02; B05C 3/09

[52] U.S. Cl. ..... 118/668; 118/416; 118/425; 118/426; 118/500; 427/185

[58] Field of Search ..... 118/421, 425, 416, 426, 118/500, 675, 668; 427/185

[56] References Cited

U.S. PATENT DOCUMENTS 1,332,934 3/1920 Tenca ..... 118/425
1,562,479 11/1925 Whitaker ..... 118/425 X
2,259,728 10/1941 Bridges ..... 118/425
2,734,481 2/1956 Johnson et al. ..... 118/421
3,503,435 3/1970 Denlop ..... 118/425 X
3,565,037 2/1971 Walling ..... 118/425
3,999,509 12/1976 Lucas ..... 118/421 X

*Primary Examiner*—Shrive P. Beck
*Attorney, Agent, or Firm*—Craig & Antonelli

[57] ABSTRACT

An automatic coating system for making set-up by coating a wax pattern with a refractory material, for use in a lost wax process. The system has a set-up pickup device adapted to pickup the set-ups by one from a set-up pool, a slurry dipping device for dipping the set-up in the slurry of the refractory coating material, a sanding device adapted to deposit sand to the coated set-up and a set-up taking-out device for taking the set-up out of the system. These devices are disposed on a common circle. The system further has aset-up transportation device located at the center of the circle. The transportation device has a plurality of beams extended radially outwardly to positions of the devices on the circle and supported by a shaft which is rotatable and movable up and down. Each beam has an arm which is adapted to hold the set-up. The beams of the transportation device are cyclically moved up and down and rotated back and forth to transport the set-ups from one to the next devices disposed on the circle.

18 Claims, 26 Drawing Figures

AUTOMATIC COATING SYSTEM FOR LOST WAX PROCESS

BACKGROUND OF THE INVENTION

The present invention relates to a lost wax precision casting process and, more particularly, to a coating system for coating a wax pattern with a refractory material to make a set-up as a step of the lost wax precision casting process.

In this specification, a body consisting of runner and a wax pattern of the final product attached to the runner will be referred to as "wax pattern body". The body after the automatic coating operation will be referred to as "mold of refractory material accommodating a wax pattern". Also, the body under the automatic coating work will be generally referred to as "set-up".

Typical conventional work for making a set-up by coating a wax pattern with a refractory material includes arranging various equipments such as slurry tank containing slurry of refractory material and sanding device such as fluidized bed, and conveying and setting the wax pattern body manually in these equipments to coat the wax pattern body with a refractory material.

In order to obtain a sufficient strength of the set-up, it is necessary to repeat the coating operation to form a plurality of coating layers. As the coating operation is repeated, the weight of the half-finished set-up is gradually increased to require a large manual force to convey and set the half-finished set-up. In addition, the repeated work itself is monotonous and has to be made under an extremely severe condition of work. For these reasons, the coating work is the object of the laborer's aversion.

Under this circumstance, it has been proposed to use known robot or transportation jigs adapted for putting the half-finished set-up into and out of the slurry tank and sanding device. This, however, is only a partial mechanization of the coating work, and is not intended for the full automatic control of the whole coating work. Therefore, it is not possible to make the coating complying with coating requirements of various set-ups and, in addition, various additional works are required. On the other hand, there is an increasing demand for a full automatic coating system which would afford a mass-production to make the full use of the advantage peculiar to the lost wax process, in order to compensate for the shortage of the manpower and to cope with the current rise of the labor cost.

SUMMARY OF THE INVENTION

It is, therefore, a major object of the invention to provide a rational automatic coating system in which all of the necessary works can be made remotely and automatically by means of a central control stand to make it possible to efficiently and safely perform the coating of a plurality of set-ups simultaneously by a single coating operator.

To this end, according to the invention, there is provided an automatic coating system comprising pickup device for picking up set-ups one by one from a set-up pool, dipping means for dipping the picked-up set-up in a slurry of a refractory material, sanding means for depositing sand to the slurry-dipped set-up, taking-out means for taking out the set-up, all of these means being disposed on a common circle, and a transportation device having functions of vertical movement and rotation for transporting the set-ups from predetermined positions of these means to the predetermined positions of the next means, the conveying device being located at the center of the above-mentioned circle.

The above and other objects, as well as advantageous features of the invention, will become more apparent and readily understandable from the following description of the preferred embodiments taken in conjunction with the accompanying drawings.

DESCRIPTION OF THE PREFERRED EMBODIMENTS

Figure 1A:
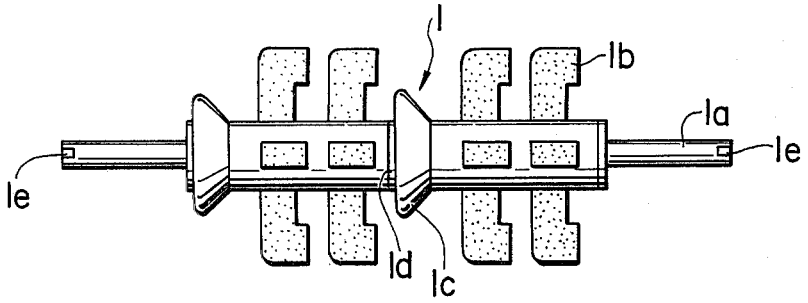
FIGS. 1A–1E are illustrations of models of various kinds of set-ups.

Referring first to FIGS. 1A–1E, a reference numeral 1 generally denotes a set-up having wax patterns **1*b*. A shaft 1*a* centered at a runner 1*c* extends through the set-up 1. The shaft 1*a* is provided at its both ends with grooves on flat surfaces 1*e* for making the shaft 1*a* engageable with motor couplings 4*d*** which will be described later.

In FIG. 1A, two wax pattern bodies are attached by means of a packing **1*d*. This number of wax pattern bodies, however, is not exclusive. The way of attaching of the set-up 1 is not limited to that shown in FIGS. 1A–1E. For instance, the shaft 1*a*** may project only in one side of the wax pattern bodies, although in such a case a slight modification of attaching/detaching jigs of various devices mentioned later will be required.

Figure 1B:
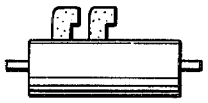
Figure 1C:
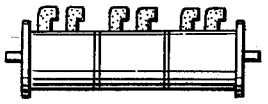
Figure 1D:
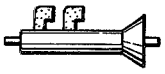
Figure 1E:
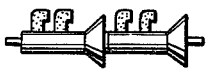

FIG. 1B and 1C show set-up constructions in which wax pattern bodies are mounted on a single or a plurality of drums, while FIGS. 1D and 1E show set-up constructions in which wax pattern bodies are attached to a single or a plurality of trees.

The set-up 1 is conveyed by means of a set-up cart 2. A set-up pickup device 3, slurry-dipping device 4, excessive-slurry tear-off device 5, sanding device 6, set-up cleaning device 7 and a set-up taking-out device 8 are disposed such that the working positions of respective devices are disposed on a common circle at a constant angular pitch. At the center of the circle, a set-up transportation device 9 is disposed. The term "working position" is used here to mean the position for setting the set-up in each of the slurry dipping device 4, excessive slurry tear-off device 5, sanding device 6 and the set-up cleaning device 7, i.e. the position at which the set-up is delivered between the set-up transportation device 9 and each device on the circle. Similarly, concerning the set-up pickup device and the set-up taking-out device, the "working position" is the positions at which the set-up is delivered between the set-up transportation device and each of the pickup and taking-out devices.

A slurry make-up tank 10 and a sand make-up tank 11 are disposed behind the slurry dipping device 4 and the sanding device 6, respectively. Also, the set-up cart 2 is set on a rotary table 12.

For an efficient coating work, a control stand 13 is located preferably at the illustrated position.

Figure 3A:
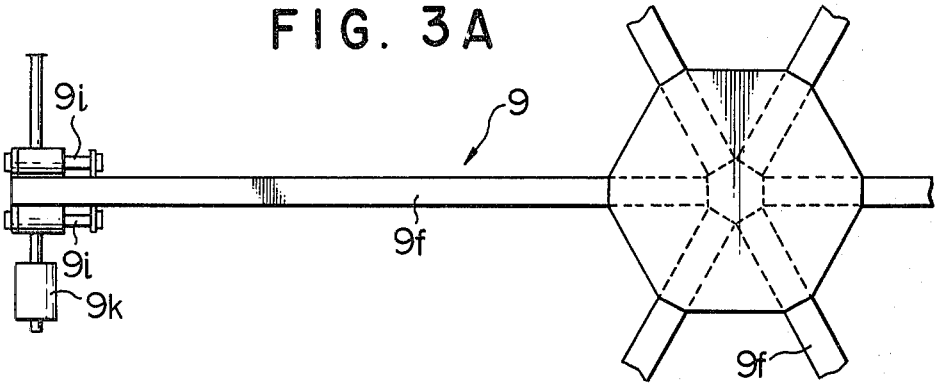
FIG. 3A and 3B are schematic illustrations of a set-up transportation device.
Figure 3B:
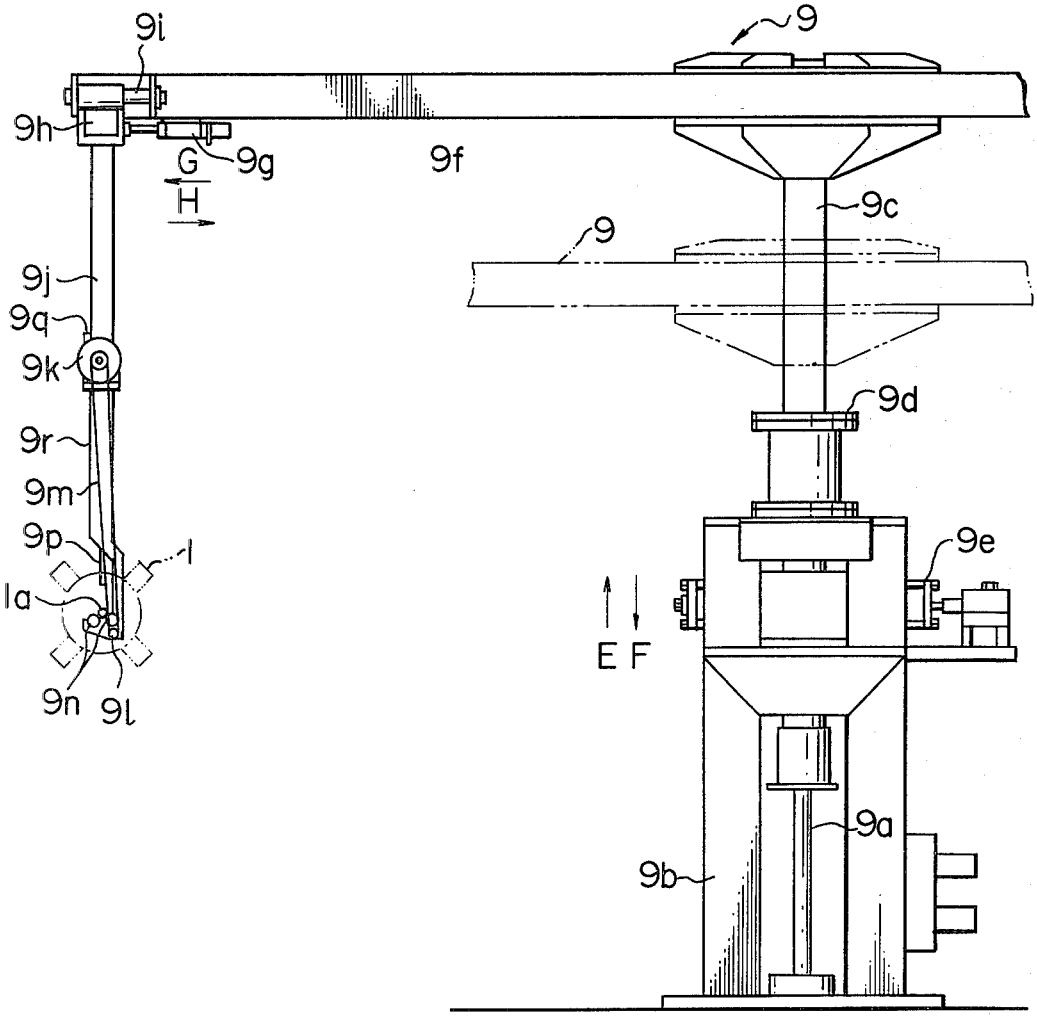
Figure 4A:
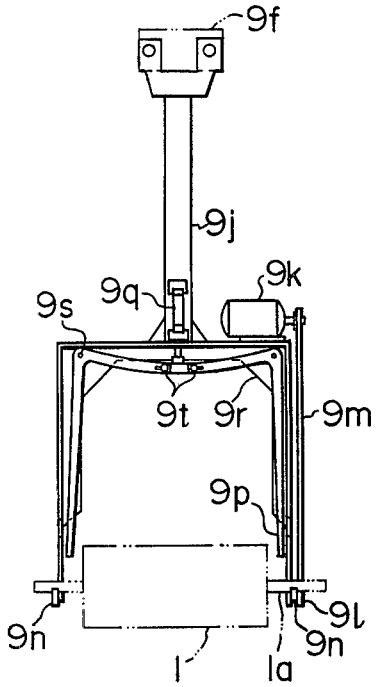
FIG. 4A is a schematic illustration of an arm of the set-up transportation device.
Figure 4B:
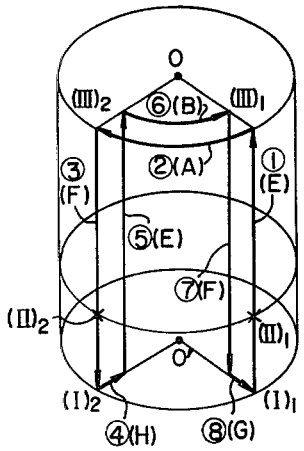
FIG. 4B is an illustration of operation of the arm of the set-up conveyor.

FIGS. 3A, 3B and 4A in combination show schematically the set-up transportation device 9, while FIG. 4B illustrates the operation of an arm of the set-up transportation device 9. More specifically, FIG. 3A is a plan view of a part of the device 9, FIG. 3B is a front elevational view of a part of the device 9 and FIG. 4A is an enlarged view of an arm 9*j*.

Figure 2:
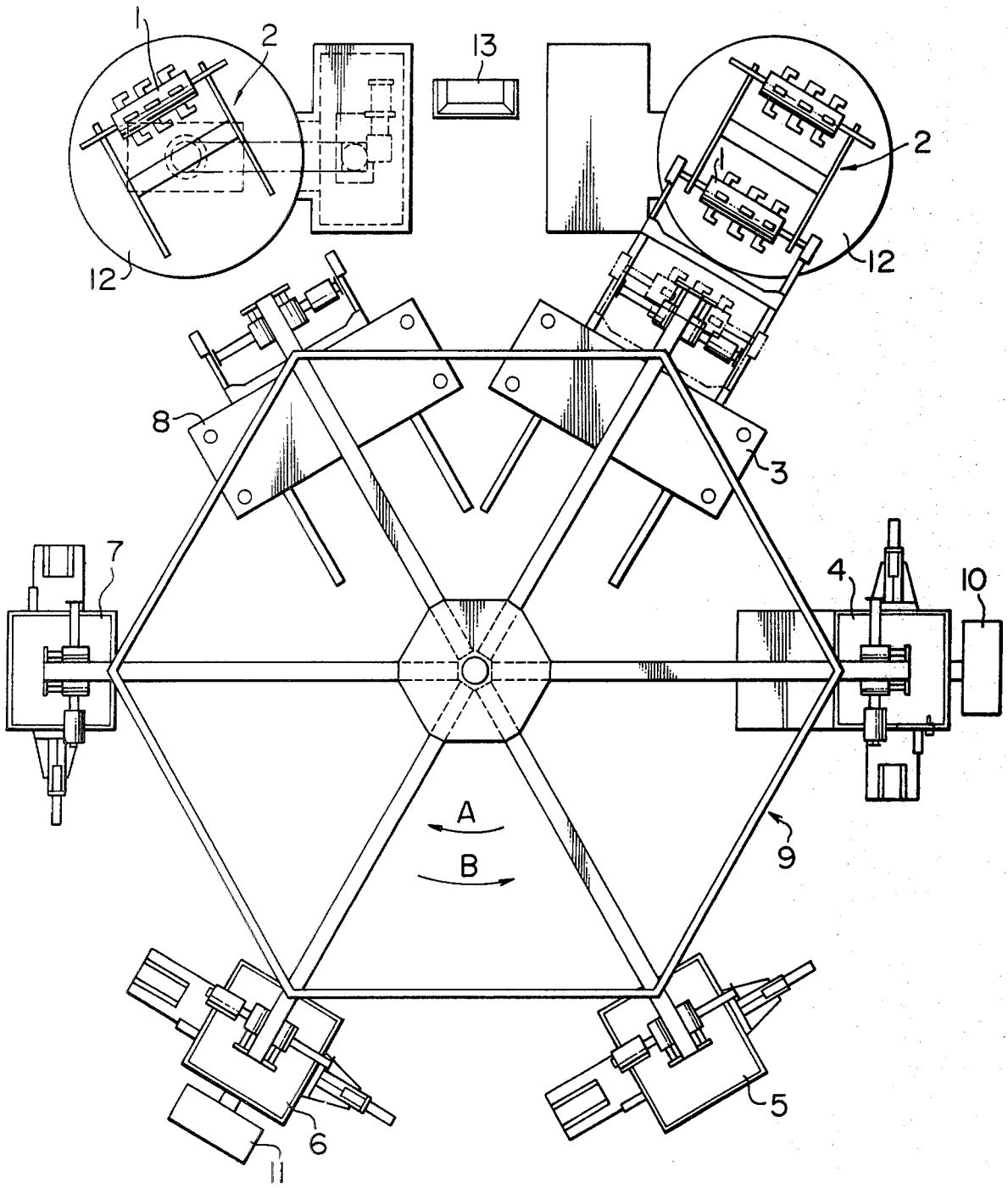
FIG. 2 shows how the devices constituting a first embodiment of the invention are arranged.

The set-up transportation device 9 has a vertical column 9*b* having a hydraulic cylinder 9*a* adapted to vertically drive a main shaft 9*c* along a guide constituted by a slide metal 9*d*. As the hydraulic cylinder 9*a* is actuated to extend its rod, the main shaft 9*c* is moved upward i.e. in the direction of arrow E in FIG. 3B along the slide metal 9*d*. Then, a hydraulic cylinder 9*e* constituting a rotary driving means is actuated to cause a 60° rotation (arrow A in FIG. 2) for transporting the set-up in the circumferential direction and, thereafter, the main shaft 9*c* is lowered as shown by arrow F in FIG. 3B. A plurality of beams 9*f* are attached to the upper end of the main shaft 9*c* and extend radially outwardly at an angular pitch of 60° in the plane normal to the main shaft 9*c*. At the end of each beam, attached is an arm seat 9*h* which is movable in the longitudinal direction of the beam along a slide shaft 9*i* by the operation of a hydraulic cylinder 9*g*. An arm 9*j* is attached to this arm seat 9*h*. The arm 9*j* is adapted to be retracted in the direction of arrow H of FIG. 3B after the lowering (arrow F of FIG. 3B) of the main shaft 9*c*. The set-up 1 is set in each of the aforementioned devices 4 to 8 as the arm 9*j* is retracted. The shaft 9*c* is moved again upward in the direction of arrow E in FIG. 3B and a backward 60° rotation is performed. Thereafter, the arm 9*j* is moved outward as shown by arrow G in FIG. 3B to be returned to the starting position I. The term "starting position I" is used here to mean the position which is slightly below the neutral axis (working position II of each device) of each set-up set in each device, where the arm 9*j* can easily clear the set-up shaft 1*a*.

More specifically, as will be understood from FIG. 4B, the set-up transportation device 9 makes a cyclic operation from the starting position $I_1$ to the starting position $I_1$ including 1 rise of main shaft 9*c* (arrow E), 2 rotation of main shaft (arrow A in FIG. 2), 3 lowering of main shaft (arrow F), 4 retraction of arm 9*j* (arrow H), 5 lifting of main shaft (arrow E), 6 backward rotation of main shaft 9*c* (arrow B in FIG. 2), 7 lowering of main shaft 9*c* (arrow F), 8 extension of the arm 9*j* (arrow G) and returning of the arm 9*j* to the starting position $I_1$. The transportation of the set-up 1 is performed in a period between the starting from the position I and the retraction of the arm 9*j*. The set-up transportation device cyclically repeats this operation. It is possible, however, to substitute a successive 60° rotation in one direction for the alternating forward and backward 60° rotation. Needless to say, the angle of each rotation of the set-up transportation device differs depending on the number of devices or stations disposed around the transportation device 9.

Referring now to FIG. 4B, the central axis of the main shaft of the set-up transportation device is represented by O–O'. Symbols $I_1$, $I_2$ represent the starting positions of the arm for the device adjacent to the arm in the fully lowered condition, while symbols $III_1$, $III_2$ represent the starting position of the arm for the device adjacent to the arm in the fully raised condition. Symbols $II_1$ and $II_2$ represent the working positions at which the set-up is exchanged between the arm of the set-up transportation device and each device.

When the set-up is transported from the slurry dipping device 4 to the excessive slurry tear-off device 5 and from the excessive slurry tear-off device 5 to the sanding device 6, it is necessary to rotate the set-up by means of a reduction motor 9*k* attached to each arm, in order to prevent the local deposition of the slurry which may result in the dropping of the slurry and cracking in the mold.

In the described embodiment, a belt 9*m* is stretched between the motor 9*k* and a pulley 9*l*. The set-up shaft 1*a* is so placed on a bearing 9*n* as to make a frictional contact with the belt 9*m*, so as to be rotated by the friction between itself and the belt 9*m* while being supported by the bearing 9*n*.

It is also preferred that the set-up on its travel from the sanding device 6 to the set-up cleaning device 7 is rotated at a high speed, only during the rising, thereby to tear-off the excessive sand to prevent the scattering of the latter. It was confirmed that, by so doing, the sand is collected at the sanding device at a high rate of collection. Therefore, it is preferable that the arm 9*j* used between the sanding device 6 and the set-up cleaning device 7 is mounted with a high-speed motor.

As a hydraulic cylinder 9*q* is actuated to drive its rod up and down for several seconds, when the set-up takes the position between 3 and 4 in FIG. 4B, the arraying claws 9*p* are oscillated around pivot pins 9*s*. In consequence, the claws 9*p* collide with the end of the set-up to effect an ordering and centering of the set-up in the axial direction. This considerably facilitates the subsequent setting of the set-up in the next device.

To this end, the claws 9*p* are connected to a member 9*t* by means of pivot pins 9*s* fixed to a beam 9*r*, and is coupled to the rod of the cylinder 9*q* by means of a pin 9*t*.

FIGS. 5A to 5D show the positional relationship between the set-up pickup device 3 and the set-up cart 2. The set-up cart 2 fully loaded with the set-up 1 is set on the rotary table 12. The set-up each set on the cart having two or more vertical support shafts are successively taken out from the cart and are placed on the working position II of set-up pickup device. The working position II is the position of center axis of the set-up placed in each device, and is slightly above the aforementioned starting position as stated before.

Figure 5A:
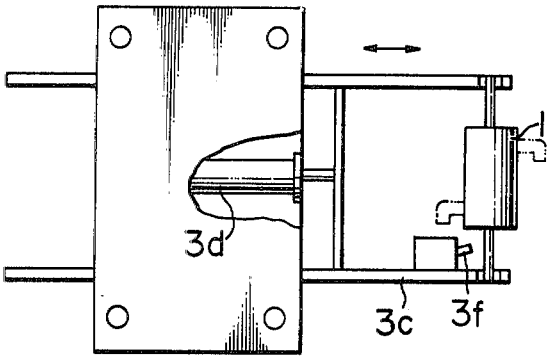
FIGS. 5A–5D are illustrations of the positional relationship between a set-up pickup device and a set-up cart and the constructions of the set-up pickup device and the set-up cart.
Figure 5B:
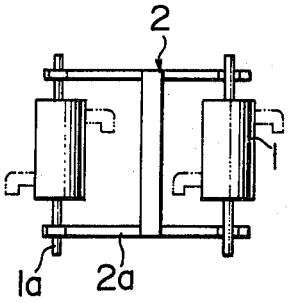
Figure 5C:
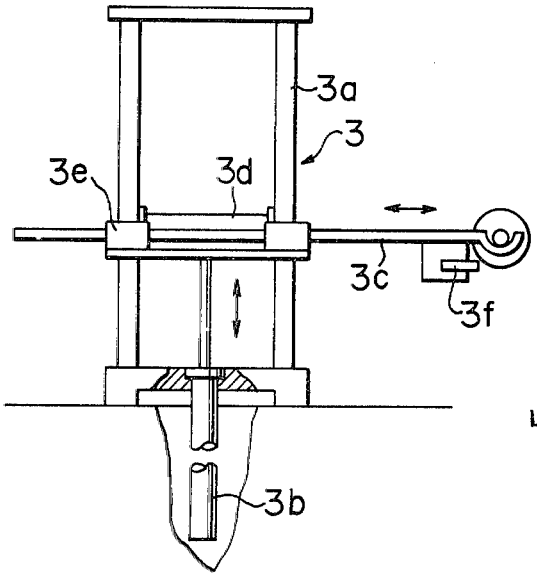
Figure 5D:
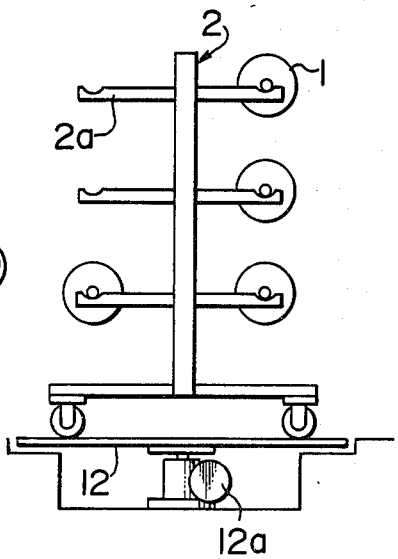

The set-up pickup device 3 has vertical guide posts 3*a* along which arms 3*c* are moved up and down by means of a hydraulic cylinder 3*b* as shown in FIG. 5C. The arms 3*c* are movable also in the direction perpendicular to the vertical guide post 3*a* along a guide member 3*e* constituted by a guide metal or rolls, by means of a hydraulic cylinder 3*d*. A sensor 3*f* such as a combination of a light source and a photoelectric tube is attached to the arm 3*c* such that the optical axis passes the set-up shaft 1*a* of the set-up carried by the set-up cart located at a predetermined position. As the set-up cart 2 loaded with the set-up 1 is placed at the predetermined position, an electric relay is actuated to cause the arm 3*c* to move upward to the uppermost position in its stroke and then lowered in accordance with the operation of the sensor.

More specifically, if there is a set-up 1 carried by the set-up cart 2, the light reflected by the set-up shaft 1*a* is detected by the photoelectric tube to make the latter actuate the electric relay thereby to drive the arm 3*c* to the position immediately below the set-up 1. Then, by the limit switch or an electric relay operative in response to the movement of the arm, the arm 3*c* is lifted to a level which permits the detaching of the set-up 1 from a shelf 2*a*. Subsequently, the arm 3*c* is retracted and moved to a position above or below the predetermined position. Thereafter, the arm is moved to a predetermined height by the operation of the electric relay, thereby to hold the set-up at a waiting position for a predetermined step of the process.

Thereafter, the above-stated operation is repeated upon operation of a time switch or an electric relay which operates in response to the completion of the work. Since the photoelectric tube does not act at the position from which the set-up has already been removed, the arm 3*c* continues to move downward and operate in the same manner as above upon detection of the set-up which is positioned just below the removed set-up. It will be seen that the set-ups carried by the set-up cart 2 are successively detached in order. Thus, the operation of the arm 3*c* includes the steps 1′ rising, 2′ lowering while making detection of set-up, 3′ moving forward, 4′ picking up set-up from cart and rising (picking up made at point marked at X), 5′ reversing and 6′ lowering, as shown in FIG. 6.

An orderly loading of the empty shelf-equipped cart at the position of the taking-out device 8 will be described hereinunder. The construction is materially identical to that shown in FIGS. 5A and 5B, except that each arm 3*c* carries two sensors such as combinations of light source and photoelectric tube. The following description, therefore, will proceed making use of the same reference numerals.

Figure 7A:
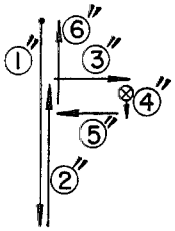
FIGS. 7A–7C are illustrations of operation of the set-up taking-out device.
Figure 7B:
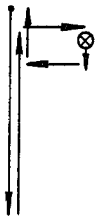
Figure 7C:
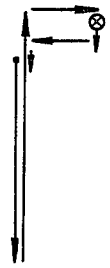

The set-up after the completion of the work is transferred to the arm 3*c* through the operation of various parts such as combination of relay and timer. The arm is then moved upward to the uppermost position and is then lowered gradually. One of the photoelectric tube detects the shelf 2*a* of the cart to ensure that the arm 3*c* operates correctly at the position of the shelf, while the other photoelectric tube detects the presence or absence of the set-up shaft on the shelf-equipped cart. If the second photoelectric tube does not detect any set-up on the cart, i.e. when there is no light input reflected by the set-up shaft, the arm 3*c* continues to move downward. If the emptiness of the cart is detected after the lowering of the arm 3*c* to the lowermost position, the arm 3*c* is moved ahead to take a position slightly above the shelf 2*a* and is then gently lowered as a result of operation of an electric relay, thereby to deliver the set-up to the shelf. For delivering the next set-up to the shelf second from the bottom, the arm 3*c* temporarily moves downward. This downward movement of the arm 3*c*, however, is terminated as the second photoelectric tube receives the reflected light input, so that the arm 3*c* moves again upward. Then, the position of the shelf second from the bottom and the emptiness of this shelf are detected by the first and the second photoelectric tubes, respectively, so that the arm is moved ahead to deliver the set-up to this shelf. This operation is repeated cyclically to orderly deliver the set-ups to the successive shelves from the lower side to the upper side. As shown in FIGS. 7A to 7C, the operation of the arm includes the steps of 1″ lowering, 2″ rising while making detection, 3″ moving forward, 4″ delivery of set-up to cart and lowering (delivery made at point marked at X), 5″ reversing and 6″ rising.

Figure 6A:
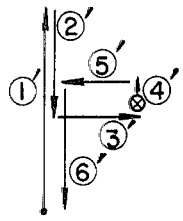
FIGS. 6A–6C are illustrations of operation of the set-up pickup device.
Figure 6B:
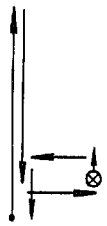
Figure 6C:
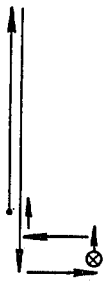

As will be seen from FIGS. 6A to 6C, as well as from FIGS. 7A to 7C, the starting positions of operations of the set-up pickup device and the set-up taking-out device are changed depending on the state of loading of the set-up cart with the set-ups. The operation of the set-up pickup device and the operation of the set-up taking-out device are controlled by means of limit switches disposed at upper and lower portions of these devices.

It is to be noted that the arm of the set-up taking-out device must have two sensors: one for detecting the set-up shaft and the other for detecting the shelf, each sensor may be constituted by a combination of a light source and a photoelectric tube.

When the set-ups 1 are mounted on both sides of the set-up cart 2 as shown in FIGS. 5A to 5D, the rotary table 12 is rotated 180° by a motor 12*a*, after completion of loading or unloading at one side, to make the other side accessible thereby to make the loading or unloading at the other side.

The slurry dipping device 4, excessive slurry tear-off device 5, sanding device 6 and the set-up cleaning device 7 have means to rotate the set-up 1 and can have set-up attaching/detaching means of the same construction. Therefore, the attaching/detaching means for the slurry dipping device 4 will be described with specific reference to FIGS. 8A amnd 8B, by way of example.

A set-up 1 is moved by the set-up transportation device 9 to a set-up holding section 4*a* which is located at a predetermined position such as upper part of the side wall of the slurry container. Then, an axially movable cylinder 4*b* is actuated to place the set-up 1 between a rotatable bearing 4*c* attached to the hydraulic cylinder 4*b* and a coupling 4*d* of a gear stepless speed changing motor or a motor 4*e*. As the motor 4*e* is energized, the set-up 1 connected between the bearing 4*c* of the hydraulic cylinder 4*b* and the coupling 4*d* of the motor 4*e* is rotated.

In the slurry dipping device 4, as well as in the excessive slurry tear-off device 5 and the sanding device 6, it is preferred to change the direction of rotation of the set-up, in order to achieve a uniform slurry coating, as well as uniform tear-off of slurry and uniform sand coating.

Figure 8A:
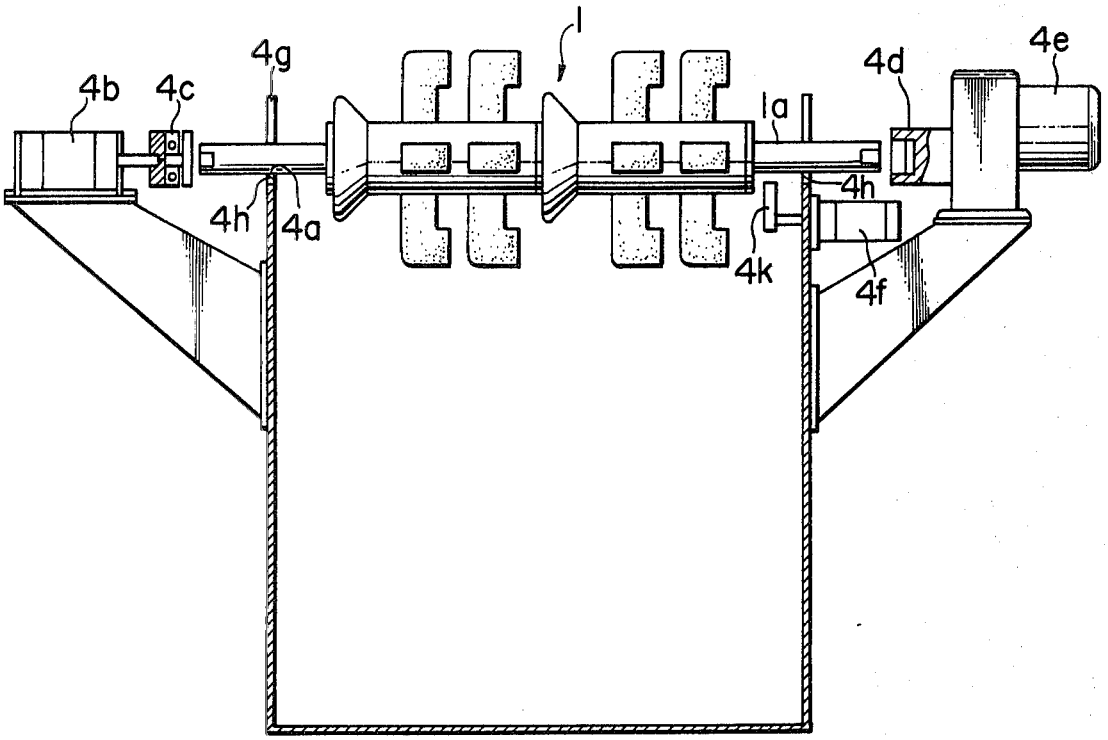
FIGS. 8A and 8C are schematic illustrations of set-up attaching/detaching and rotary device and modified one mounted on the container devices.
Figure 8B:
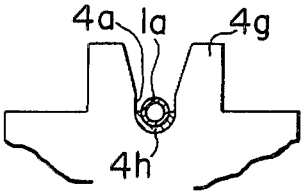
FIG. 8B is an illustration of the holding set-up in FIGS. 8A and 8C.

For disconnecting the set-up 1 from the motor coupling 4*d*, the shoe 4*k* of the hydraulic cylinder 4*f* is moved to the left as viewed in FIG. 8A to displace the right end of the set-up 1 to the left.

Figure 8C:
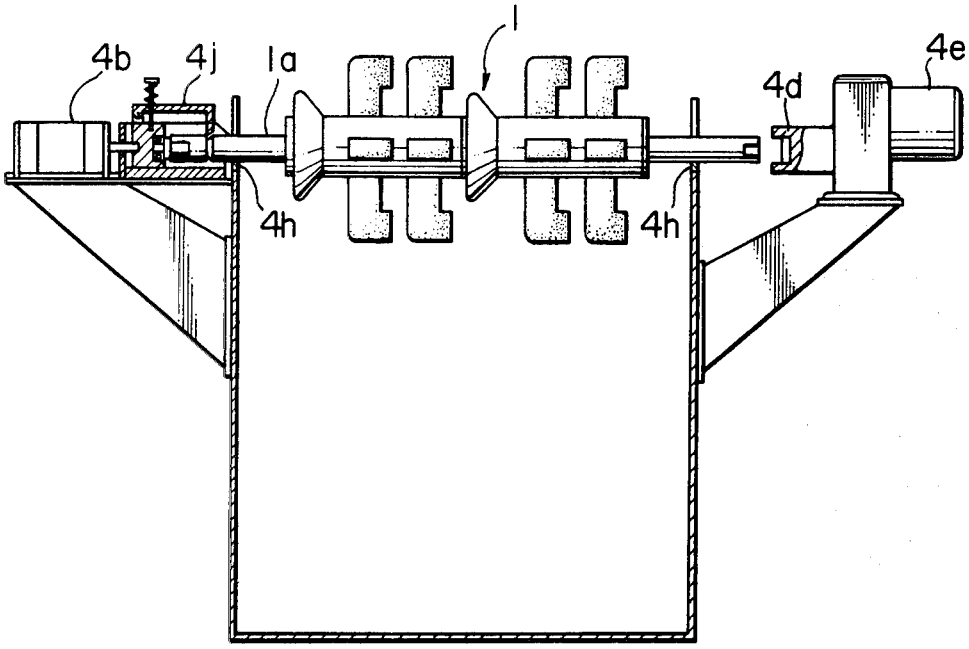
Figure 8D:
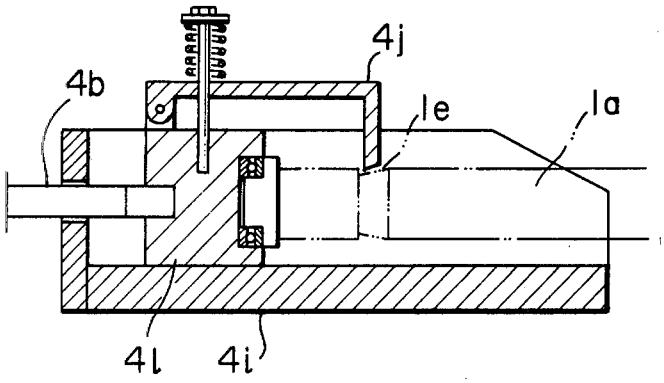
FIG. 8D is an enlarged illustration of another detaching method.

Alternatively, a bearing block 4l having a claw 4*j* is slidably mounted on a bearing guide 4*i* as shown in FIGS. 8C and 8D. A part such as groove 1*e* of the set-up shaft 1*a* is brought into engagement with the claw 4*j*. As the cylinder 4*b* is contracted, the block 4l is moved to the left to pull the set-up 1 out of the motor coupling 4*d*. As the block is moved to the right, it causes the claw 4*j* to engage the groove 1*e* of the shaft. In this case, the bearing guide 4*i* is kept stationary by a suitable means such as shown in FIG. 8C.

A guide 4*g* is provided for facilitating the delivery of the set-up 1 by the set-up transportation device 9 to each device. Also, the set-up holding section 4*a* is preferably provided with an oil-less bearing 4*h* to protect the shaft 1*a* and to ensure a smooth rotation of the same. The coupling 4*d* for rotating the set-up may be directly fixed to the shaft of the motor 4*e* or may be mounted on a shaft which is operatively connected to the motor shaft through the medium of sprockets. All what is required is that the coupling 4*d* is so connected to the motor shaft as to be driven by the latter. Needless to say, the hydraulic cylinders 4*b*, 4*f* can be substituted by various other cylinders such as pneumatic cylinders.

The slurry dipping device 4 is constituted by a slurry tank having a known stirring mechanism, while the sanding device is constituted by a known fluidized bed or the like means. The aforementioned attaching detaching means and rotational driving means are annexed to the slurry tank and the fluidized bed.

The rotation speed of the excessive slurry tear-off device can be changed easily and steplessly by means of a stepless speed changing motor which can be controlled from the control stand 13.

Figure 9A:
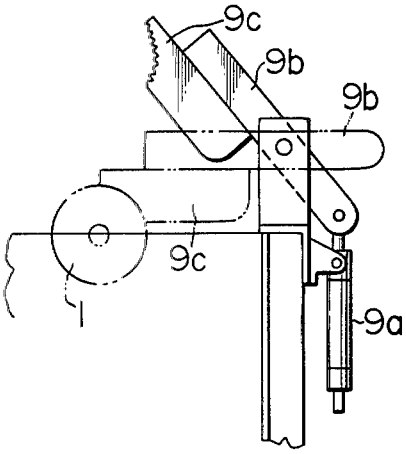
FIGS. 9A and 9B are schematic illustrations of operation of a claw of a set-up cleaning device.
Figure 9B:
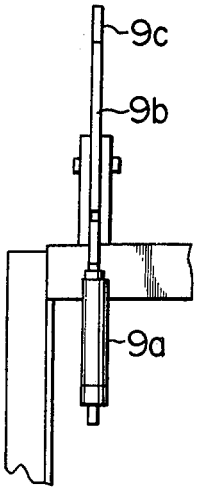

The set-up cleaning device 7 is provided for cleaning the packing 1*d*, in order to facilitate the separation of the set-up. As will be seen from FIGS. 9A and 9B, the cleaning device 7 has a claw 9*c* held by a holding plate 9*b* which in turn is driven by pneumatic cylinder 9*a*. Needless to say, it is necessary to avoid interference of members to support the set-up, such as arms 9*j* (FIG. 4A), arms 3*c* (FIG. 5A) and set-up holding sections 4*a* (FIG. 8A).

The series of operation including the steps of picking up of the set-up, application of slurry, tearing off of excessive slurry, sanding, set-up cleaning and taking-out of set-up is completed during the operation period between the retraction of arm 9*j* (arrow H) of the arm 9*j* of the set-up transportation device 9 and the returning of the arm 9*j* to the starting position I.

If one or more of the slurry dipping device 4, excessive slurry tear-off device 5, sanding device 6 and set-up cleaning device 7 requires longer operation time, the speed of the set-up transportation device is determined in accordance with the operation of such device requiring the longer operation time.

Similarly, the set-up transportation device 9 is required to operate such that it is ready for catching the set-ups by the time at which the operation is completed in the device or station requiring the longest operation time.

Generally, in the coating work in lost wax process, the slurry dipping is the most important step and requires the longest operation time. It is, therefore, recommended that the operation timing of the set-up transportation device be determined in accordance with the operation time in this slurry dipping step. Also, it is possible to arrange such that the beams of the set-up transportation device can operate independently in accordance with the operation time peculiar to the device with which the beam is concerned.

To the contrary, if the work is completed in one of the devices earlier than in the other devices, the set-up 1 is moved upward from the starting position II together with the hydraulic cylinder 4*b*, bearing 4*c*, hydraulic cylinder 4*f*, coupling 4*d* and the geared motor or the motor 4*e* will stepless speed changing motor, and is rotated at the raised position. In case of the slurry dipping device, the undesirable local thickening of the slurry is fairly avoided by rotating the set-up at a position above the slurry surface so that a higher quality of the mold is ensured.

The slurry dipping device 4 and the sanding device 6 are provided with slurry storage tank 10 and sand storage tank 11. These tanks may be installed integrally with the respective device or separately behind the respective devices. The slurry dipping device 4 and the sanding device 6 are continuously and automatically supplied with the slurry and sand from respective tanks 10, 11 by means of pumps or screw feeders of the conventional type.

It is recommended that the slurry dipping device, slurry storage tank, sanding device and sand storage tank are prepared as a set for each kind of coating material and are installed on rails to permit an easy replacement of these devices and tanks in accordance with the kind of the coating material used.

The construction and operation of the coating system of the invention have been described. The constituent devices of the system are all controlled from the control stand 13 to which all informations and functions of the operation of the system are concentrated.

It is remarkable that the time required for coating, which is about 4 to 5 minutes per workpiece to be coated in the conventional case, is shortened to 30 to 60 seconds in the system of the invention. In addition, since all of the works are performed fully automatically, it is possible to obtain uniform and superior quality. In fact, a remarkable improvement in percentage available after the dewaxing is attained. Also, the rate of accident such as broken mold is reduced from 5% to substantially 0%.

As has been described, according to the invention, the coating operation for making set-ups by coating wax pattern with a refractory material, in the lost wax precision casting process, is made automatically and remotely by a sole coating operator. If the preparation and supply of the materials have been correctly made in advance to the operation of the system, the work is performed fully automatically requiring the operator only to observe the safe operation of the system.

This is turn relieves the workers from heavy work under severe working condition and contributes greatly to improvement of the efficiency of the coating work in the lost wax precision casting process.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An automatic coating system for making a set-up by coating a wax pattern with a refractory material in lost wax process, comprising a set-up pickup device adapted for picking set-ups one by one from a set-up storage section, whereby said set-ups enter said system; a slurry dipping device adapted for receiving said set-ups and for dipping said set-ups in a slurry of a coating refractory material; a sanding device adapted for receiving said set-ups and for depositing sand on the surface of said set-ups; and a set-up taking-out device for removing said set-ups out of said system; said devices being disposed on a common circle; said automatic coating system further comprising a set-up transportation device, wherein said set-up transportation device is disposed at the center of said circle and includes a vertical column, cylinder means attached to said vertical column, a guide member attached to said vertical column, a main shaft movable up and down by the operation of said cylinder means along said guide member attached to said vertical column, a rotational driving means attached to said vertical column and adapted to cause a rotation of said main shaft around its own axis, a plurality of beams attached to the upper end of said main shaft and extending radially outwardly in a plane perpendicular to the axis of said main shaft, each beam having attached to an end thereof farthest from said main shaft an arm, a cylinder mounted on each beam, slide shafts mounted on each beam, each arm being movable along said slide shafts attached to said beam in the longitudinal direction of said beam by the operation of said cylinder mounted on said beam, each arm having means for holding, rotating and centering said set-ups, whereby said set-up transportation device is adapted to vertically move the set-ups and move said set-ups rotationally from one device to the next respective device around said common circle, for transporting said set-ups from predetermined positions in respective devices to predetermined positions in respective next devices.

2. An automatic coating system as claimed in claim 1, wherein said slurry dipping device has a slurry storage tank which is connected to or unitary with said slurry dipping device.

3. An automatic coating system as claimed in claim 1 or 2, wherein said sanding device has a sand storage tank which is connected to or unitary with said sanding device.

4. An automatic coating system as claimed in claim 1, wherein said set-up pickup device includes a main body having at least two vertical guide posts, an arm for holding set-ups, cylinder means adapted for moving said arm up and down in the longitudinal direction of said guide posts, cylinder means adapted to drive said arm back and forth in the direction perpendicular to the longitudinal direction of said guide posts, a sensor carried by said arm and adapted to detect the presence of a set-up positioned in said set-up storage section, and electric relays adapted to operate in response to a signal from said sensor, whereby said arm is moved up and down and back and forth by a cooperation of said electric relays, sensor and said cylinder means to remove set-ups one by one from said storage section.

5. An automatic coating system as claimed in claim 9, wherein said set-up taking-out device includes a main body having at least two vertical guide posts, an arm for holding a set-up and for transferring the set-up to a shelf of a set-up cart, cylinder means for driving said arm up and down in the longitudinal direction of said guide posts, cylinder means adapted for driving said arm back and forth in the direction perpendicular to said guide posts, a first sensor carried by said arm and adapted to detect whether a set-up shaft is positioned on a shelf on said set-up cart, a second sensor carried by said arm and adapted to detect the shelf of said set-up cart, and electric relays operative in response to signals derived from said first and second sensors, whereby said arm is moved up and down and back and forth by a cooperation of said sensors, electric relays and cylinder means to transfer the set-up to a shelf of said set-up cart.

6. An automatic coating system as claimed in claim 1, wherein said means for holding, rotating and centering said set-ups include bearing means for supporting said set-up in a substantially horizontal position, said bearing means being adapted to rotate in order to cause the set-up thereon to rotate.

7. An automatic coating system as claimed in claim 1 or 6, wherein said means for holding, rotating and centering said set-ups includes oscillating means for contacting the ends of the set-ups to effect centering of the set-up in the axial direction on said arm.

8. An automatic coating system for making a set-up by coating a wax pattern with a refractory material in lost wax process, comprising a set-up pickup device adapted for picking set-ups one by one from a set-up storage section, whereby said set-ups enter said system; a slurry dipping device adapted for receiving said set-ups and for dipping said set-ups in a slurry of a coating refractory material; a sanding device adapted for receiving said set-ups and for depositing sand on the surface of said set-ups; and a set-up taking-out device for taking said set-ups out of said system, said devices being disposed on a common circle, said automatic coating system further comprising a set-up transportation device disposed at the center of said circle and having means for causing vertical movement of the set-ups and rotary movement of the set-ups around said common circle from one device to the next respective device for transporting said set-ups from predetermined positions in respective devices to predetermined positions in respective next devices, wherein said set-up pickup device includes a main body having at least two vertical guide posts, an arm for holding said set-up and for removing said set-up from said set-up storage section, cylinder means adapted for moving said arm up and down in the longitudinal direction of said guide posts, cylinder means adapted to drive said arm back and forth in the direction perpendicular to the longitudinal direction of said guide posts, a sensor carried by said arm and adapted to detect a set-up positioned in said set-up storage section, and electric relays adapted to operate in response to a signal from said sensor, whereby said arm is moved up and down and back and forth by a cooperation of said electric relays, sensor and said cylinder means to remove set-ups one by one from said storage section.

9. An automatic coating system as claimed in claim 8, wherein said slurry dipping device has a slurry storage tank which is connected to or unitary with said slurry dipping device.

10. An automatic coating system as claimed in claim 9, wherein said sanding device has a sand storage tank which is connected to or unitary with said sanding device.

11. An automatic coating system as claimed in claim 8, wherein said sanding device has a sand storage tank which is connected to or unitary with said sanding device.

12. An automatic coating system for making a set-up by coating a wax pattern with a refractory material in lost wax process, comprising a set-up pickup device adapted for picking set-ups one by one from a set-up storage section, whereby said set-ups enter said system; a slurry dipping device adapted for receiving said set-ups and for dipping said set-ups in a slurry of a coating refractory material; a sanding device adapted for receiving said set-ups and for depositing sand on the surface of said set-ups; and a set-up taking-out device for taking said set-ups out of said system, said devices being disposed on a common circle, said automatic coating system further comprising a set-up transportation device disposed at the center of said circle and having means for causing vertical movement of the set-ups and rotary movement of the set-ups around said common circle from one device to the next respective device for transporting said set-ups from predetermined positions in respective devices to predetermined positions in next respective devices, wherein said set-up taking-out device includes a main body having at least two vertical guide posts, an arm for holding a set-up and for transferring the set-up to a shelf of a set-up cart, cylinder means for driving said arm up and down in the longitudinal direction of said guide posts, cylinder means adapted for driving said arm back and forth in the direction perpendicular to said guide posts, a first sensor carried by said arm and adapted to detect whether a set-up shaft is positioned on a shelf on said set-up cart, a second sensor carried by said arm and adapted to detect the shelf of said set-up cart, and electric relays operative in response to the signals derived from said first and second sensors, whereby said arm is moved up and down and back and forth by a cooperation of said sensors, electric relays and cylinder means to transfer the set-up to a shelf of said set-up cart.

13. An automatic coating system as claimed in claim 12, wherein said slurry dipping device has a slurry storage tank which is connected to or unitary with said slurry dipping device.

14. An automatic coating system as claimed in claim 13, wherein said sanding device has a sand storage tank which is connected to or unitary with said sanding device.

15. An automatic coating system as claimed in claim 12, wherein said sanding device has a sand storage tank which is connected to or unitary with said sanding device.

16. An automatic coating system as claimed in claim 1, 8 or 12, wherein at least one of said slurry dipping device or said sanding device has a set-up holding section for holding said set-up while the set-up is positioned at the at least one device, said set-up holding section comprising a bearing adapted for rotatably supporting one end of said set-up shaft and movable in the axial direction of said set-up shaft and a coupling through which a torque of a motor shaft is transmitted to the other end of said set-up shaft, whereby said set-up shaft is caused to rotate while the set-up is positioned at the at least one device.

17. An automatic coating system as claimed in claim 1, 8 or 12, further comprising an excessive-slurry tear-off device positioned after said slurry dipping device and a set-up cleaning device positioned after said sanding device, each of said excessive-slurry tear-off device and set-up cleaning device being positioned on said common circle.

18. An automatic coating system as claimed in claim 4, 5, 8 or 12, wherein each of the sensors comprise a combination of a light source and a photoelectric tube.

* * * * *